US005477256A

United States Patent [19]

Loyd et al.

[11] Patent Number: 5,477,256

[45] Date of Patent: Dec. 19, 1995

[54] INK MIST FILTER

[75] Inventors: John C. Loyd, Centerville; Russell L. Bartley, Urbana, both of Ohio

[73] Assignee: Scitex Digital Printing, Inc., Dayton, Ohio

[21] Appl. No.: 858,930

[22] Filed: Mar. 27, 1992

[51] Int. Cl.[6] ..... B41J 2/175

[52] U.S. Cl. ..... 347/93; 347/6; 347/7; 347/34

[58] Field of Search ..... 347/22, 25, 34, 347/84, 85, 93, 92, 6, 7, 89; 400/701; 15/312.2, 301

[56] References Cited

U.S. PATENT DOCUMENTS

| | | | |
|---|---|---|---|
| 4,153,902 | 5/1979 | Kanayama | 347/92 |
| 4,320,407 | 3/1982 | Goldis et al. | 347/92 |
| 4,399,446 | 8/1983 | McCann et al. . | |
| 4,460,904 | 7/1984 | Oszczakiewicz et al. | 347/92 X |
| 4,502,055 | 2/1985 | Horike et al. | 347/92 |
| 4,772,900 | 9/1988 | Nagoshi | 347/7 |
| 4,929,969 | 5/1990 | Morris | 347/87 |
| 5,289,211 | 2/1994 | Morandotti et al. | 347/7 |
| 5,289,212 | 2/1994 | Carlotta | 347/93 X |

FOREIGN PATENT DOCUMENTS

| | | | |
|---|---|---|---|
| 0011364 | 1/1985 | Japan | 347/92 |
| 0209147 | 8/1989 | Japan | 347/34 |

OTHER PUBLICATIONS

*IBM Technical Disclosure Bulletin,* vol. 18, No. 12, Edds, K. E., et al., "Improving In K Absorption of Porous Structures", pp. 4075–4076, May 1976.

*Primary Examiner*—Matthew S. Smith
*Attorney, Agent, or Firm*—Barbara Joan Haushalter

[57] ABSTRACT

A vacuum system solves the heretofore unknown problem of mist generation from an ink reservoir under vacuum. The vacuum system includes an ink reservoir and a vacuum pump for supplying vacuum to the ink reservoir. A mist filter is housed in a housing associated with the vacuum system for capturing ink mist from the ink reservoir.

13 Claims, 2 Drawing Sheets

INK MIST FILTER

TECHNICAL FIELD

The present invention relates to continuous ink jet printers and, more particularly, to an apparatus for the collection of ink mist generated in an ink reservoir.

BACKGROUND ART

Ink jet printing systems are known in which a print head defines one or more rows of orifices which receive an electrically conductive recording fluid from a pressurized fluid supply manifold and eject the fluid in rows of parallel streams. Printers using such print heads accomplish graphic reproduction by selectively charging and deflecting the drops in each of the streams and depositing at least some of the drops on a print receiving medium, while others of the drops strike a drop catcher device.

In an ink supply system for an ink jet printer of the type shown in U.S. Pat. No. 4,399,446, clogging of the vacuum system downstream of the ink reservoir was observed during testing of the system. The clogging material appeared to be ink which entered the vacuum system, proceeded through the system to a restriction, dried in the restriction, and caused clogging.

This problem was exacerbated by a high degree of ink splatter in the ink reservoir in the area of the vacuum port, which is where much of the ink entering the vacuum port was believed to originate. Several attempts were made to solve this problem. One method for solving this problem was to install a baffle to prevent splattered ink from entering the vacuum port. However, clogging of the vacuum system still occurred, in spite of the effectiveness of the baffle in splatter control.

Another attempt to solve the clogging problem was to separate the suck dry vacuum and the system vacuum to isolate the two systems. Although no ink appeared to enter the system vacuum when this method was employed, clogging of the system vacuum still occurred. Upon further investigation, dried ink mist was unexpectedly discovered in a T-fitting connecting the ink reservoir to the system vacuum, and in a check valve in the system vacuum. The pattern of the build up in the check valve indicated that the clogging was caused by a gradual accumulation of ink mist which was dried by the continual flow of air through the system. Thus, a heretofore unknown problem of ink mist generation from an ink reservoir under vacuum was identified.

It is seen then that there is a need for an ink mist filter to collect mist and eliminate clogging of the system vacuum.

SUMMARY OF THE INVENTION

This need is met by the system according to the present invention, wherein an apparatus collects ink mist generated in an ink reservoir under vacuum. Various materials were used to attempt to collect the mist. For example, a porous plastic cigarette shaped filter was tested, but proved to be too easily clogged by the mist. Finally, it was determined that melamine foam provided the needed level of reliability.

In accordance with one aspect of the present invention, a vacuum system comprises an ink reservoir and a vacuum pump for supplying vacuum to the ink reservoir. The vacuum system further comprises a mist filter housed in a housing for capturing ink mist from the ink reservoir.

Accordingly, it is an object of the present invention to provide a vacuum system for solving the heretofore unknown problem of mist generation from an ink reservoir under vacuum. Other objects and advantages of the invention will be apparent from the following description, the accompanying drawings and the appended claims.

DETAILED DESCRIPTION OF THE PREFERRED EMBODIMENTS

Figure 1:
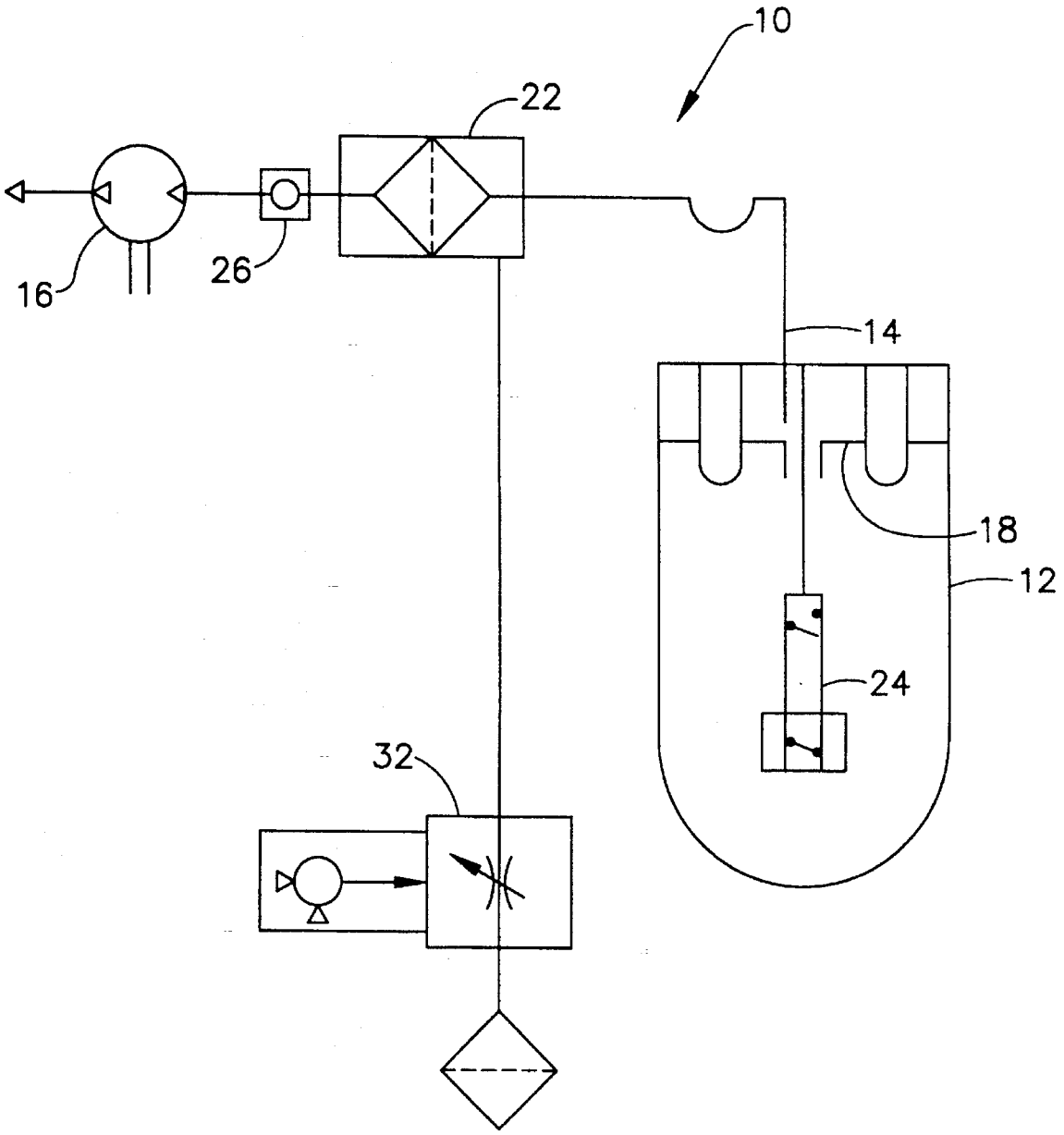
FIG. 1 is a block diagram of a preferred embodiment of the vacuum system of the present invention.

The present invention protects vacuum system components from ink mist generated in the air from an ink reservoir. Referring to the drawings, in FIG. 1 a vacuum system 10 is illustrated. The vacuum system 10 includes an ink reservoir 12 which stores ink for recirculation in an ink supply system for a typical ink jet printer of the type shown in commonly assigned U.S. Pat. No. 4,399,446, issued Aug. 16, 1983, to McCann et al. The ink reservoir 12 is under vacuum to provide a means for returning ink from the ink supply system to the ink reservoir 12. In the top of the ink reservoir 12 is a port 14 to which a vacuum source, such as vacuum pump 16, is attached. The vacuum in the ink reservoir 12 is provided by vacuum pump 16, which may be any commercially available vacuum pump such as a WISA model no. 113.079.100.0.

Continuing with FIG. 1, the port 14 is situated well above the surface of the ink stored in the ink reservoir 12 and is protected from splatter in the reservoir 12 by a baffle 18. The baffle 18, located above a float switch 24 for controlling the fluid level in the ink reservoir 12, protects against the high degree of ink splatter which can occur in the ink reservoir 12 in the area of the vacuum port 14. The baffle 18 was originally installed to prevent splattered ink from entering the vacuum port 14. However, clogging of the vacuum system continued to be observed in spite of the effectiveness of the baffle 18 in splatter control. The problems of ink mist and ink splatter which cause clogging of the vacuum system, then, are most effective when the baffle 18 is used in conjunction with a mist filter 20, shown in FIG. 2.

Figure 2:
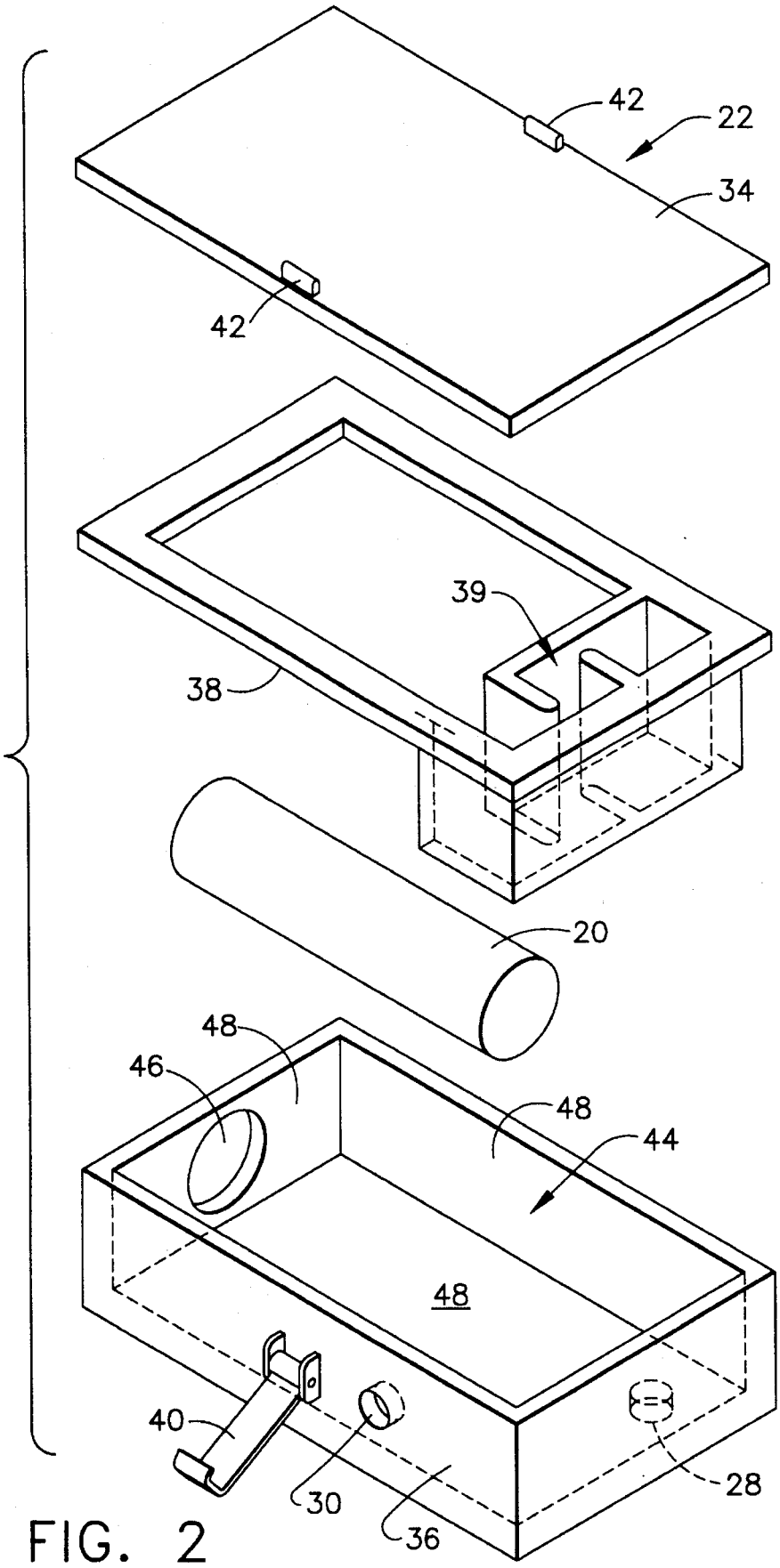
FIG. 2 is an exploded view of a mist filter housing of FIG. 1.

A mist filter housing 22 containing the mist filter 20 shown in FIG. 2, is connected between the vacuum pump 16 and the ink reservoir 12 to protect the vacuum pump 16 from ink mist and moisture. The mist filter 22 eliminates clogging of the vacuum system downstream of the ink reservoir caused by dried ink mist in the system 10. For example, dried ink mist was unexpectedly discovered in a check valve 26 in the system vacuum. The clogging in the check valve 26 caused by a gradual accumulation of mist which was dried by the continual flow of air through the system 10, then, is eliminated by the inclusion of the ink mist filter 20. Thus, the present invention has identified a heretofore unknown problem of mist generation in an ink reservoir 12 under vacuum.

Referring now to FIG. 2, and continuing with FIG. 1, an exploded view of the housing 22 is shown to illustrate the mist filter 20. A first inlet port 28 of the housing 22 connects directly to the top of the ink reservoir 12 by a straight connecting fitting. It is preferable to avoid connecting fittings which may have flow direction changes that can provide opportunity for ink mist to collect. A second inlet port 30 of the housing 22 is connected to a servo controlled vacuum bleed 32, shown in FIG. 1, which regulates the vacuum in the ink reservoir 12.

The housing 22 of FIG. 2 comprises a lid 34, an enclosure means 36, a pliable insert 38, latch means 40, and the mist filter 20. The lid 34 is preferably a flat, aluminum plate, and may include notches 42 for securing the latch means 40. Of course, it will be obvious that any of a variety of suitable latch means are possible, and the latch means 40 is shown for purposes of illustration only and is not to be considered as limiting the invention.

Continuing with FIG. 2, the enclosure means 36 comprises a cavity 44, the first and second inlet ports 28 and 30, respectively, and an outlet port 46, typically larger in diameter than the inlet ports 28 and 30. The pliable insert 38 is securely insertable in the cavity 44 and serves as a seal between the lid 34 and the enclosure means 36. The pliable insert 38 further provides a tortuous air path 39 to collect large mist particles.

The mist filter 20 is preferably a non-hollow, cylindrically shaped filter which securely fits in the outlet port 46 of the enclosure means 36. The mist filter 20 material is preferably a melamine foam, or equivalent material, having minuscule lattice-work openings on the order of 140 microns each. As the air-mist mixture from the reservoir 12 flows through the filter 20, the resulting ink mist collects on the lattice work openings of the filter 20. Eventually, of course, the mist filter may become restricted by the collection of ink mist, and may require replacement. Replacement of the mist filter 20 is a simple matter, merely requiring opening of the latch means 40 to access the filter 20.

Under certain environmental conditions, condensation of water vapor in the air from the reservoir 12 can occur on interior side and bottom walls 48 of the filter housing 22. This moisture can possibly collect to the point that it is passed on to the vacuum pump 16 through the mist filter 20. To eliminate this potential problem, the vacuum bleed 32 of fresh air is included in the system 10 to reduce the humidity in the filter housing 22. Inclusion of the vacuum bleed 32 in the system 10 also provides the advantage of allowing greater latitude in the onset of condensation.

INDUSTRIAL APPLICABILITY AND ADVANTAGES

The present invention is useful in the field of ink jet printing, and has the advantage of protecting vacuum system components from ink mist generation from an ink reservoir, using an ink mist filter. The present invention provides the further advantage of allowing more reliable operation of the ink supply system for an ink jet printer. Finally, the vacuum system of the present invention provides the advantage of controlling condensation in the ink mist filter.

Having described the invention in detail and by reference to the preferred embodiment thereof, it will be apparent that other modifications and variations are possible without departing from the scope of the invention defined in the appended claims.

What is claimed is:

1. A vacuum system comprising:

an ink reservoir;

a means for supplying vacuum to the ink reservoir; and a mist filter for capturing ink mist from the ink reservoir, the mist filter housed in a housing, the housing comprising an enclosure means having sides and a bottom for defining a cavity, and further having at least a first inlet port and at least a first outlet port; a lid detachably attached to the enclosure means; and latch means for detachably attaching the lid to the enclosure means.

2. A vacuum system as claimed in claim 1 further comprising a servo-controlled vacuum bleed for regulating the vacuum supplied to the ink reservoir.

3. A vacuum system as claimed in claim 1 further comprising a port associated with the ink reservoir and attached to the means for supplying vacuum to the ink reservoir.

4. A vacuum system as claimed in claim 3 further comprising a baffle for protecting the port from ink splatter in the ink reservoir.

5. A vacuum system as claimed in claim 1 wherein the means for supplying vacuum to the ink reservoir comprises a vacuum pump.

6. A vacuum system as claimed in claim 1 wherein the mist filter comprises a melamine foam.

7. A vacuum system as claimed in claim 1 wherein the mist filter is shaped to be securely insertable in the first outlet port.

8. A vacuum system as claimed in claim 1 further comprising a pliable insert securely insertable in the cavity of the enclosures means for providing a tortuous air path to collect ink mist particles.

9. A vacuum system comprising:

an ink reservoir under vacuum;

a mist filter for capturing ink mist from the ink reservoir; and a vacuum bleed for regulating the vacuum in the ink reservoir, the mist filter housed in a housing, the housing comprising an enclosure means having sides and a bottom for defining a cavity, and further having at least a first inlet port and at least a first outlet port; a lid detachably attached to the enclosure means; and latch means for detachably attaching the lid to the enclosure means.

10. A vacuum system as claimed in claim 9 wherein the vacuum bleed comprises a servo-controlled vacuum bleed.

11. A vacuum system as claimed in claim 9 wherein the mist filter comprises a melamine foam.

12. A vacuum system as claimed in claim 9 wherein the mist filter is shaped to be securely insertable in the first outlet port.

13. A vacuum system as claimed in claim 9 further comprising a pliable insert securely insertable in the cavity of the enclosure means for providing a tortuous air path to collect ink mist particles.

* * * * *